US005161740A

United States Patent [19]

Kuykendal et al.

[11] Patent Number: 5,161,740

[45] Date of Patent: Nov. 10, 1992

[54] POP JET FOUNTAIN

[76] Inventors: Robert L. Kuykendal, 3435 Hawthorne, St. Louis, Mo. 63104; David R. Usher, 118 Oakwood, St. Louis; Ronald S. Delchmann, 6040 Circle Dr., House Springs, both of Mo. 63119

[21] Appl. No.: 592,774

[22] Filed: Oct. 4, 1990

[51] Int. Cl.[5] ..... B05B 17/08

[52] U.S. Cl. ..... 239/23; 239/17; 239/590.3; 239/590.5

[58] Field of Search ..... 239/590, 590.3, 590.5, 239/16, 21, 17, 22, 23, 99, 101, 12, 553, 553.3, 553.5, 18, 19, 20

[56] References Cited

U.S. PATENT DOCUMENTS

| | | | |
|---|---|---|---|
| 2,627,439 | 2/1953 | Wornall | 239/590.5 |
| 2,633,908 | 4/1953 | Brierly | 239/553.3 |
| 3,484,045 | 12/1969 | Waters | 239/23 |
| 3,630,444 | 12/1971 | Nelson | 239/590.3 |
| 3,684,175 | 8/1972 | Hruby, Jr. | 239/22 |
| 3,801,010 | 4/1974 | Hruby, Jr. | 239/590.5 |
| 4,795,092 | 1/1989 | Fuller | 239/12 |

FOREIGN PATENT DOCUMENTS

| | | | |
|---|---|---|---|
| 157331 | 12/1953 | Sweden | 239/590.3 |

*Primary Examiner*—Andres Kashnikow
*Assistant Examiner*—Christopher G. Trainor

[57] ABSTRACT

The present invention is an apparatus for creating a "pop jet" type of ornamental fountain with an output stream in the form of surface-tension envelope or "ball" of fluid, embedded with air bubbles. By virtue of the laminar nature of the fluid created, the natural surface tension of the fluid prevents the envelope from flying apart into multiple fluid drops. The envelope therefore can be created much larger than has been possible previously. Previous attempts at building "pop jet" type fountains have been limited to creating relatively small envelopes due to the internal turbulence of the fluid. The present invention minimizes internal turbulence by utilizing various advances in envelope shape, outlet orifice design and diffuser strucutre. It enhances the size of the envelope produced by adding fluid and air bubbles outside the outlet orifice by directing the output stream sthrough a secondary pool of fluid.

2 Claims, 3 Drawing Sheets

POP JET FOUNTAIN

BACKGROUND—FIELD OF INVENTION

This invention relates to fluid flow devices and particularly to that class of fluid nozzles which create a laminar discharge stream.

BACKGROUND—DESCRIPTION OF PRIOR ART

Attractive water fountain displays have been important to mankind since ancient times. One class of ornamental display fountain effect, commonly called a "pop jet", consists of a small conventional discharge nozzle plus an electrical or hydraulically operated valve capable of being turned on or off in rapid succession to create a momentary burst of water or other fluid which is frequently directed to the vertical or near vertical. Such fountain effects are often grouped in sets of two to several dozen and are programmed to release their individual bursts in various forms of sequential patterns to create wave effects or other pleasing visual patterns. The problem with conventional "pop jets" is that the fluid they discharge is highly turbulent. This turbulence causes the discharge to break into multiple drops unless the volume of fluid discharged is kept very small. It was our objective, in developing the present invention, to make various advances in the design of "pop jet" fountain effects such that the discharge would be laminar and would remain essentially in one surface-tension envelope. The ball of fluid thus created would be much larger than has been possible previously and its effect would be enhanced by embedding multiple air bubbles therein. We were not successful in finding prior patent art for any "pop jets" per se, since, in their conventional form, they consist of merely a conventional nozzle and valve, although Waters, U.S. Pat. No. 3,484,045, teaches an amusement device for simulating a natural geyser. The field of laminar flow nozzles is more substantial, however, but none relate directly to pop jet effects and to embedding air bubbles within the discharge to enhance their envelope size and visual effect.

Prior efforts to reduce the turbulence in a stream of fluid are shown in U.S. Pat. Nos. 2,432,641; 4,119,276; 3,851,825; 3,630,444; 3,730,439; 4,393,991; 3,321,140; 2,054,964; 2,408,588; 3,730,440; 3,801,010; 2,633,908; 2,627,439 and Swedish patent number 157,331. Fuller, U.S. Pat. No. 4,795,092 teaches a laminar flow nozzle which might be a distinct improvement over the prior art. However, Fuller's "flow straightening devices" and "tangential input port" produce a pleasing effect but appear to be neither necessary nor sufficient for reducing turbulence enough for the desired pop jet nozzle effect.

OBJECTS AND ADVANTAGES

It is the object of this invention to create a nozzle method and assembly incorporating various means to produce a "pop jet" fountain effect such that the discharge is laminar and will remain essentially in one surface-tension envelope. The envelope or ball of fluid thus created is much larger than has been possible previously and its effect is enhanced by being filled with air bubbles. The ornamental effect of watching such a ball of fluid discharged into the air, where it travels upward until stopped by gravity and then falls back to earth, is very pleasing. It can be likened to watching high speed stroboscopic photography of (magnified) rain drops being variously contorted as they fall to earth. Their individual shapes and appearance can be likened to very large amoebas.

DRAWING FIGURES

REFERENCE NUMERALS IN DRAWINGS

10: Enclosure Means
12: Outlet Orifice
14: Output Fluid Envelope
16: Secondary Pool Retaining Wall
17: Secondary Pool
18: Diffuser Means
20: Control Valve
21: Connecting Tube
22: Inlet Port
24: Bleeder Valve
26: Bleeder Tube
28: Pressurized Reservoir
30: Dead Air Space
32: Bypass Valve
34: Bypass Tube
36: Supply Tube

DETAILED DESCRIPTION OF THE INVENTION

Figure 1:
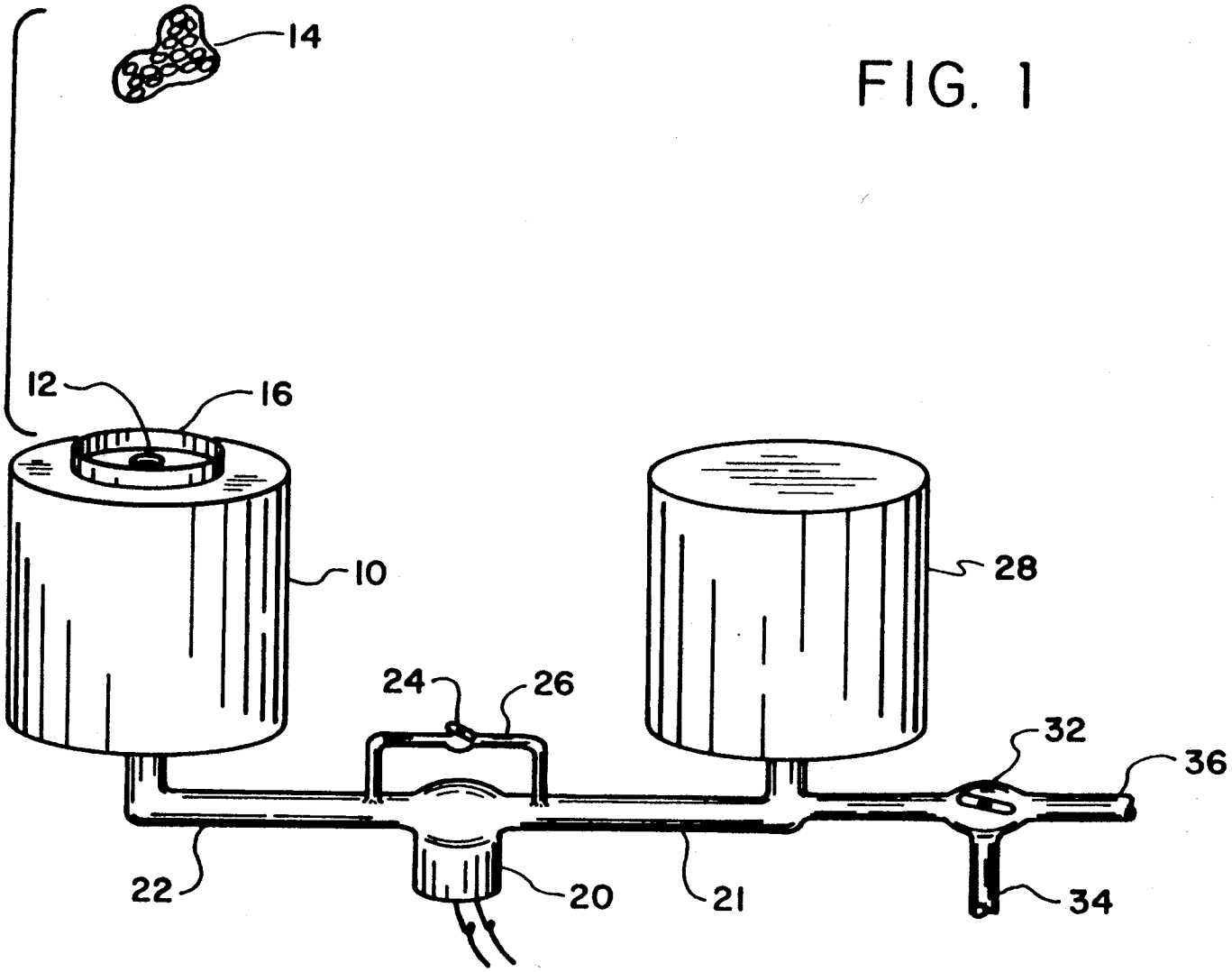
FIG. 1 is perspective view of the present invention.

FIG. 1 is a perspective view of the preferred embodiment of the present invention showing the Enclosure Means (10) to be typically of cylindrical shape. It has just discharged the Output Fluid Envelope (14), a very large laminar ball of fluid embedded with air bubbles.

Figure 2:
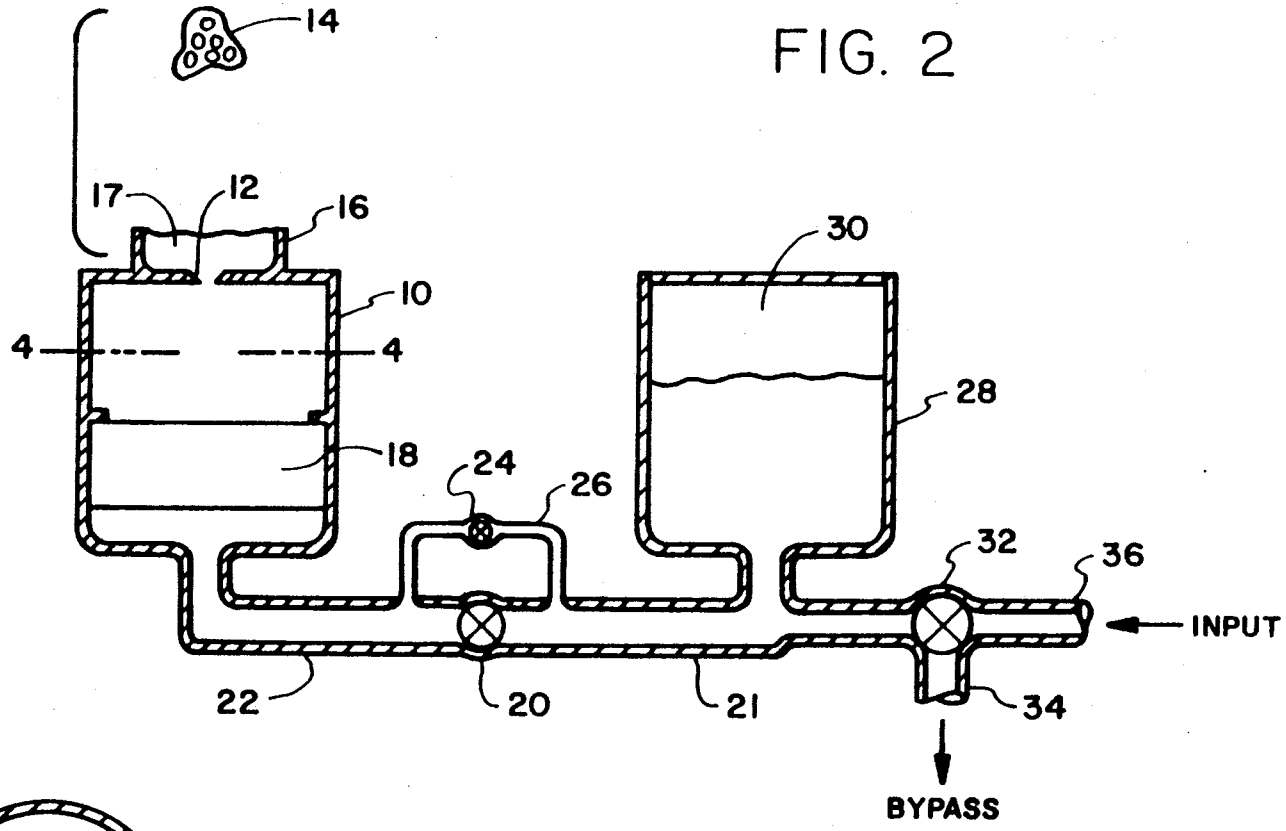
FIG. 2 is a sectional view of the present invention.
Figure 4:
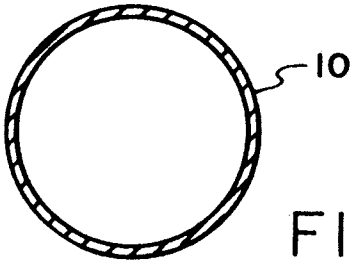
FIG. 4 is a cross sectional view of the Enclosure Means showing its typically cylindrical shape.

FIG. 2 is a sectional view of the present invention revealing an Supply Tube (36), which accepts pressurized fluid from some external source, connected to a Bypass Valve (32), which is designed to direct fluid flow into the Connecting Tube (21), when in its "normal" position or to discharge the fluid through the Bypass Tube (34), when in its "bypass" position. With said Bypass Valve (32) in its "normal" position, fluid is allowed to flow into the Connecting Tube (21) and into either the Pressurized Reservoir (28) or through the Control Valve (20), through the Inlet Port (22) and into the Enclosure Means (10). Said Enclosure Means (10) is typically a fluid impervious enclosure made up of welded flat or curved panels of metal or plastic material to contain the pressurized fluid and provide passages means for pressurized fluid to flow from said Inlet Port (22), through the Diffuser Means (18), through the substantially sharp edged Outlet Orifice (12), said outlet orifice constituting a step reduction in flow area from the area of the flow path within said enclosure means, and out through the Secondary Pool (17). Said Secondary Pool (16) is a shallow body of fluid enclosed by the Secondary Pool Retaining Wall (16) and continuously supplied with fluid, to the point of overflowing said Secondary Pool Retaining Wall (16), by the low volume flow of fluid around said Control Valve (20) by means of the Bleeder Tube (26) and the Bleeder Valve (24). Said Outlet Orifice (12) has a cross-sectional area which is only a small fraction of the cross-sectional area of said Enclosure Means (10). Located near the lower end of said Enclosure Means (10) is a body of materials the Diffuser Means (18), which is typically a combination of open mesh screens, open celled foam material, a parallel tube assembly or other diffusing means, said turbulence reducing means being a means for defining a large plurality of small area flow paths across said flow area between said inlet port and said outlet orifice for developing laminar flow in said enclosure means by reducing the Reynolds number of the flow of said fluid within said enclosure means. Said Pressurized Reservoir (28) contains a Dead Air Space (30) of air compressed by the pressurized fluid which has flowed in from said Connecting Tube (21). In the preferred embodiment, said Control Valve (20) is a relatively fast acting valve which is switched from the "open" to the "closed" position either manually or by some external mechanical, electrical, hydraulic or other means.

Figure 3:
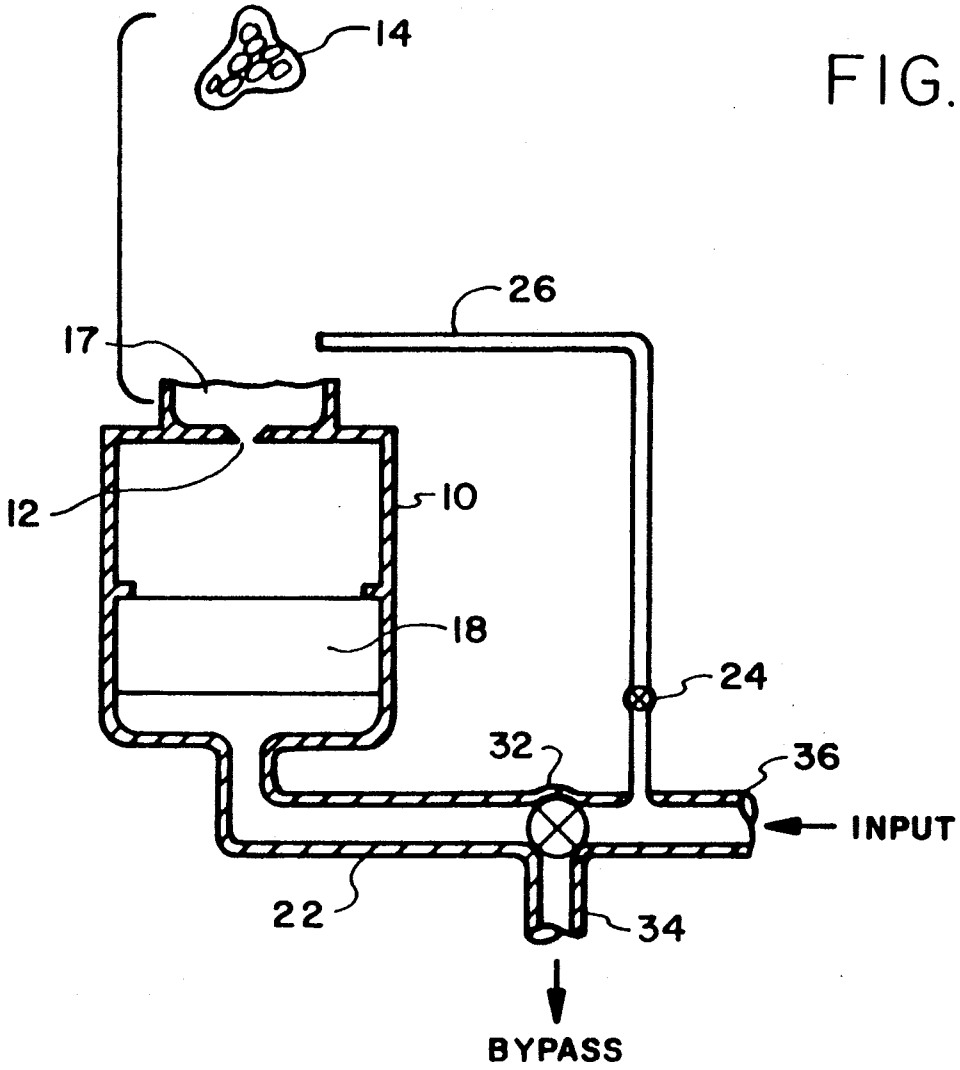
FIG. 3 is a sectional view of an alternate embodiment of the present invention.

FIG. 3 is a sectional view of an alternate embodiment of the present invention in which said Pressurized Reservoir (28), said Dead Air Space (30), said Connecting Tube (21) and said Control Valve (20) are all omitted. In this embodiment said Bypass Valve (32) is a relatively fast acting valve which is switched from the "normal" to the "bypass" position either manually or by some external mechanical, electrical, hydraulic or other means. Also, in this embodiment, said Bleeder Valve (24) and said Bleeder Tube (26) are connected directly to said Inlet Tube (36) and fluid flowing out of said Bleeder Tube (26) is allowed to fall by gravity into the Secondary Pool (17), a shallow basin created by said Secondary Pool Retaining Wall (16).

OPERATION

FIGS. 1 and 2 The path of fluid flow through the present invention is, from some external pump or other source of pressurized fluid, into said Inlet Tube (36), into said Bypass Valve (32), which is used to adjust pressure within the system and allow for efficient pump operation by discharging excess fluid out through Bypass Tube (34) and directing the remainder into said Connecting Tube (21). Pressurized fluid then flows either into said Pressurized Reservoir (28) or out of said reservoir according to whether said Control Valve (20) is in its "open" position or "closed" respectively, said reservoir thus functioning as a means of evening flow demand to the external pressurized fluid source and as fluid reserve means. Whenever said Control Valve (20) is momentarily placed in its "open" position, fluid rushes forward, through said Inlet Port (22) and into the lower end of said Outside Enclosure Means (10) and through said Diffuser Means (18). Because total flow area through said Outside Enclosure Means (10) and said Diffuser Means (18) is significantly greater than through said Inlet Port (22), in a manner familiar to practitioners to the art, the Reynolds Number and thus the turbulence of the fluid flow is greatly reduced. Thus, fluid, which then flows through said knife-edged Outlet Orifice (12), is of very low turbulence. As the fluid then passes through said Secondary Pool (17), it remains of relatively low turbulence while it picks up additional fluid, by molecular adhesion, and air bubbles. Because said Control Valve (20) is of a type capable of opening and closing rapidly, and because, by external electrical, hydraulic or other means, it is made to do so, the flow of fluid out of the "pop jet" fountain is of relatively short duration. Also, since turbulence within the fluid has been made to remain relatively low, even as it passes through said Secondary Pool, the surface tension surrounding the ball of fluid thus discharged is able to essentially prevent it from flying apart into multiple drops. Thus the discharged ball of fluid tends to remain in one surface-tension envelope even as it changes shape in response to air currents, rather resembling a very large amoeba. Said Bleeder Tube (26) and Bleeder Valve (24) allow a small amount of fluid to flow around said Control Valve (20), during the part of each cycle in which said Control Valve (20) is in the "closed" position, and through said Outside Enclosure Means (10) to re-fill said Secondary Pool (17).

FIG. 3 is a sectional view of an alternate embodiment of the present invention in which said Pressurized Reservoir (28), said Dead Air Space (30), said Connecting Tube (21) and said Control Valve (20) are all omitted. In this embodiment said Bypass Valve (32) is a relatively fast acting valve which is switched from the "normal" to the "bypass" position either manually or by some external mechanical, electrical, hydraulic or other means. Also, in this embodiment, said Bleeder Valve (24) and said Bleeder Tube (26) are connected directly to said Inlet Tube (36) and fluid flowing out of said Bleeder Tube (26) is allowed to fall by gravity into said Secondary Pool (17). Fluid flow through this embodiment is similar to that of the preferred embodiment except for those items omitted. This embodiment has the advantage of being lower in cost and complexity to build. It has the disadvantage of being less efficient in the use of fluid pressure and flow from the external source.

SUMMARY, RAMIFICATIONS AND SCOPE

Although the description above contains many specifications, these should not be construed as limiting the scope of the invention but as merely providing illustrations of some of the presently preferred embodiments of this invention. For example, an alternate embodiment of the present invention may be to deliver liquid lubricant to otherwise inaccessible mechanical assemblies for industrial applications.

Thus the scope of the invention should be determined by the appended claims and their legal equivalents, rather than by the examples given.

We claim:

1. A device for producing a laminar fluid output stream of substantially short duration and substantially infused with air bubbles, said fluid stream being of sufficient velocity for use in ornamental fountains and industrial applications comprising:

an enclosure means having an inlet port and an outlet orifice and defining a flow path between said inlet port and said outlet orifice and said outlet orifice having a flow area no more than a small fraction of the flow area within said enclosure means and said outlet orifice being a substantially sharp edged orifice and said outlet orifice constituting a step reduction in flow area from the area of the flow path within said enclosure means and said enclosure means being a means for containing a volume of fluid under pressure for producing an output envelope and; a supply tube for supplying fluid to the inlet port;

turbulence reducing means disposed within said enclosure means between said inlet port and said outlet orifice and said turbulence reducing means being a means for defining a large plurality of small area flow paths across said flow area between said inlet port and said outlet orifice for developing laminar flow in said enclosure means by reducing the Reynolds number of the flow of said fluid within said enclosure means and;

a secondary pool retaining means disposed externally around said outlet orifice and attached to said enclosure means to enable the creation of a secondary pool of fluid externally around said outlet orifice and a bleeder tube and valve defining a substantially low volume flow path to substantially continuously fill and replenish said secondary pool with fluid and;

a substantially fast acting control valve disposed within said supply tube to enable and disable the flow of fluid into said inlet port, said valve being controlled by manual, electrical, hydraulic or mechanical means.

2. The device of claim 1 wherein a pressurized fluid reservoir is attached to the supply tube upstream of said control valve to smooth input flow of the fluid and lessen demands upon an external source of pressurized fluid.

* * * * *

UNITED STATES PATENT AND TRADEMARK OFFICE

CERTIFICATE OF CORRECTION

PATENT NO. : 5,161,740

DATED : November 10, 1992

INVENTOR(S) : Robert L. Kuykendal et al

It is certified that error appears in the above-identified patent and that said Letters Patent is hereby corrected as shown below:

On the title page, Item [54], third inventor should read:

--Ronald S. Deichmann--

Signed and Sealed this

Sixteenth Day of March, 1993

*Attest:*

STEPHEN G. KUNIN

*Attesting Officer*

*Acting Commissioner of Patents and Trademarks*